US008997363B2

(12) United States Patent
Rahmanian et al.

(10) Patent No.: US 8,997,363 B2
(45) Date of Patent: Apr. 7, 2015

(54) TARGET POSITIONING SYSTEMS AND METHODS

(75) Inventors: Paul Rahmanian, Aliso Viejo, CA (US); Armin J. Koroghli, Laguna Niguel, CA (US); Arthur R. Fransen, Brea, CA (US)

(73) Assignee: Paragon Tactical, Inc., Corona, CA (US)

( * ) Notice: Subject to any disclaimer, the term of this patent is extended or adjusted under 35 U.S.C. 154(b) by 471 days.

(21) Appl. No.: 13/455,927

(22) Filed: Apr. 25, 2012

(65) Prior Publication Data

US 2013/0285328 A1 Oct. 31, 2013

(51) Int. Cl.

| | |
|---|---|
| ***F41J 1/10*** | (2006.01) |
| ***F41J 7/00*** | (2006.01) |
| ***F41J 7/04*** | (2006.01) |
| *F41J 9/02* | (2006.01) |

(52) U.S. Cl.

CPC .... *F41J 1/10* (2013.01); *F41J 7/00* (2013.01); *F41J 7/04* (2013.01); *F41J 9/02* (2013.01)

(58) Field of Classification Search

CPC ..... F41J 1/10; F41J 7/00
USPC ..... 33/506, 1 PT; 273/406
See application file for complete search history.

(56) References Cited

U.S. PATENT DOCUMENTS

| | | | | | |
|---|---|---|---|---|---|
| 1,281,687 | A * | 10/1918 | Stelling | 273/406 |
| 2,104,171 | A * | 1/1938 | Schwerin | 273/406 |
| 2,284,510 | A * | 5/1942 | Cates | 273/407 |
| 2,372,111 | A * | 3/1945 | Norberg | 273/407 |
| 2,538,118 | A * | 1/1951 | Miller | 273/407 |
| 4,088,322 | A * | 5/1978 | Nikoden, Jr. | 273/406 |
| 4,373,923 | A * | 2/1983 | Kilwin | 464/36 |
| 5,163,689 | A * | 11/1992 | Bateman | 273/406 |
| 5,350,180 | A * | 9/1994 | Acock | 273/406 |
| 6,256,893 | B1 * | 7/2001 | Forborgen | 33/1 PT |
| 6,789,042 | B2 * | 9/2004 | Boyton | 702/150 |
| 7,303,192 | B2 * | 12/2007 | Marshall et al. | 273/406 |
| 7,914,004 | B2 * | 3/2011 | Wright et al. | 273/406 |
| 8,561,306 | B2 * | 10/2013 | Busse-Grawitz et al. | 33/1 PT |
| 2004/0244209 | A1 * | 12/2004 | Uehira et al. | 33/1 PT |
| 2012/0043722 | A1 * | 2/2012 | Mironichev et al. | 273/406 |

* cited by examiner

*Primary Examiner* — Christopher Fulton
(74) *Attorney, Agent, or Firm* — Klein, O'Neill & Singh, LLP

(57) ABSTRACT

The system includes a rotation disengagement mechanism configured to disengage a rotatable shaft from a powered drive unit such that upon disengagement the powered drive unit is no longer able to rotate the shaft. After disengagement, the rotatable shaft may reengage the powered drive unit at only one rotational position relative to the rotation disengagement mechanism. A target coupled to the shaft is thus always in a known home position. The systems and methods further comprise smart positioning logic that assigns a number designation to four rotational orientations spaced 90° from one another.

14 Claims, 7 Drawing Sheets

TARGET POSITIONING SYSTEMS AND METHODS

BACKGROUND

The present embodiments relate to positioning systems for shooting targets.

DESCRIPTION OF RELATED ART

Target positioning systems are used with targets of the type commonly found at shooting ranges. These targets are secured by a clamp to hang from a rotatable drive unit. The target is typically rotatable between a face position in which the target faces the shooter, and edge positions in which opposite edges of the target face toward and away from the shooter. A motor within the powered drive unit rotates the clamp, and in turn the target.

One problem with current target positioning systems is that positioning error may cause the target to not be at a desired rotational orientation. For example, an externally applied force may move the target out of a current rotational position, but the target positioning system is unaware that the force was applied. Therefore, the target system assumes that the target is at the desired rotational orientation when in fact it is not. The system must then be re-calibrated or manually adjusted to achieve the desired rotational orientation.

SUMMARY

The various embodiments of the present target positioning systems and methods have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide the advantages described herein.

One of the present embodiments comprises apparatus for rotationally positioning a target. The apparatus comprises a rotatable shaft having a lower end configured to support a target and an upper end operatively coupled to a powered drive unit configured to rotate the shaft among a plurality of rotational positions around an axis; and a rotation disengagement mechanism operatively coupling the shaft to the powered drive unit and operable to disengage the rotatable shaft from the powered drive unit in response to a threshold rotational force, and to allow the shaft to be reengaged with the powered drive unit at only a pre-selected one of the rotational positions.

Another of the present embodiments comprises a system for continuously calibrating a rotatable shaft so that the shaft is at a desired rotational orientation. The system comprises a rotatable shaft having a lower end configured to support a target and an upper end operatively coupled to a powered drive unit configured to rotate the shaft among a plurality of rotational positions around an axis; a rotation disengagement mechanism operatively coupling the shaft to the powered drive unit; a position indicator associated with the rotatable shaft for detecting a rotational orientation of the rotatable shaft; and a control unit including a processor for executing code to direct the operation of the powered drive unit; wherein the system is configured to rotate the powered drive unit by an amount sufficient to rotate the rotation disengagement mechanism in a first direction by an amount greater than 360°; while rotating the rotation disengagement mechanism, engage the rotatable shaft with the powered drive unit so that the rotatable shaft rotates under the influence of the powered drive unit; rotate the shaft in a second direction opposite the first direction; detect a rotational orientation of the rotatable shaft; and halt rotation of the shaft in the second direction when the detected rotational orientation of the shaft corresponds to the desired rotational orientation.

Another of the present embodiments comprises a method of positioning a rotatable shaft at a desired rotational orientation. The method comprises rotating a powered drive unit operatively coupled to the rotatable shaft by an amount sufficient to rotate a rotation disengagement mechanism associated with the shaft in a first direction by an amount greater than 360°; while rotating the rotation disengagement mechanism, engaging the rotatable shaft with the powered drive unit so that the rotatable shaft rotates under the influence of the powered drive unit; rotating the shaft in a second direction opposite the first direction; a position indicator associated with the rotatable shaft detecting a rotational orientation of the rotatable shaft; and halting rotation of the shaft in the second direction when the detected rotational orientation of the shaft corresponds to the desired rotational orientation.

Another of the present embodiments comprises a method of correcting a rotational position of a rotatable shaft. The method comprises rotating the shaft from a first rotational position to a second rotational position; a position indicator associated with the rotatable shaft detecting a rotational orientation of the rotatable shaft at the second position; and determining whether the rotational orientation of the rotatable shaft at the second position falls within a predetermined angular distance of a desired rotational position of the rotatable shaft.

Another of the present embodiments comprises a method of correcting a rotational position of a rotatable shaft. The method comprises rotating the shaft from a first rotational position to a second rotational position; measuring an actual elapsed time $t_A$ during rotation of the shaft; comparing $t_A$ to an expected quantity of time necessary to rotate the shaft from the first rotational position to the second rotational position, $t_E$; and if $t_A \neq t_E$, determining that the rotatable shaft is not at a desired rotational position.

Another of the present embodiments comprises a method of positioning a rotatable shaft at a desired rotational position. The method comprises (a) assigning numerical values to each of a plurality of rotational positions; (b) positioning the shaft in a start position having a first assigned numerical value; (c) rotating the shaft in a first direction from the start position toward a position having a second assigned numerical value; (d) detecting the rotational position of the shaft when the shaft reaches the position having the second assigned numerical value; and (e) repeating steps (c) and (d) until the shaft reaches a rotational position having a numerical value assigned to the desired position.

Another of the present embodiments comprises a system for continuously calibrating a rotatable shaft so that the shaft is at a desired rotational orientation. The system comprises a rotatable shaft having a lower end configured for removable attachment of a target and an upper end operatively coupled to a powered drive unit configured to rotate the shaft among a plurality of rotational positions around an axis; a rotation disengagement mechanism operatively coupling the shaft to the powered drive unit; a position indicator associated with the rotatable shaft for detecting a rotational orientation of the rotatable shaft; and a control unit including a processor for executing code to direct the operation of the powered drive unit. When the shaft rotates due to an externally applied force, the system is configured to automatically a) activate the powered drive unit to rotate the rotation disengagement mechanism; b) while rotating the rotation disengagement mechanism, engage the rotatable shaft with the powered drive unit so that the rotatable shaft rotates under the influence of the powered drive unit; c) rotate the shaft in a second direction opposite the first direction; d) detect a rotational orientation of the rotatable shaft; and e) halt rotation of the shaft in the second direction when the detected rotational orientation of the shaft corresponds to the desired rotational orientation; wherein the foregoing steps a)-e) are performed with no manual input.

BRIEF DESCRIPTION OF THE DRAWINGS

The various embodiments of the present target positioning systems and methods now will be discussed in detail with an emphasis on highlighting the advantageous features. These embodiments depict the novel and non-obvious target positioning systems and methods shown in the accompanying drawings, which are for illustrative purposes only. These drawings include the following figures, in which like numerals indicate like parts.

DETAILED DESCRIPTION

Figure 1:
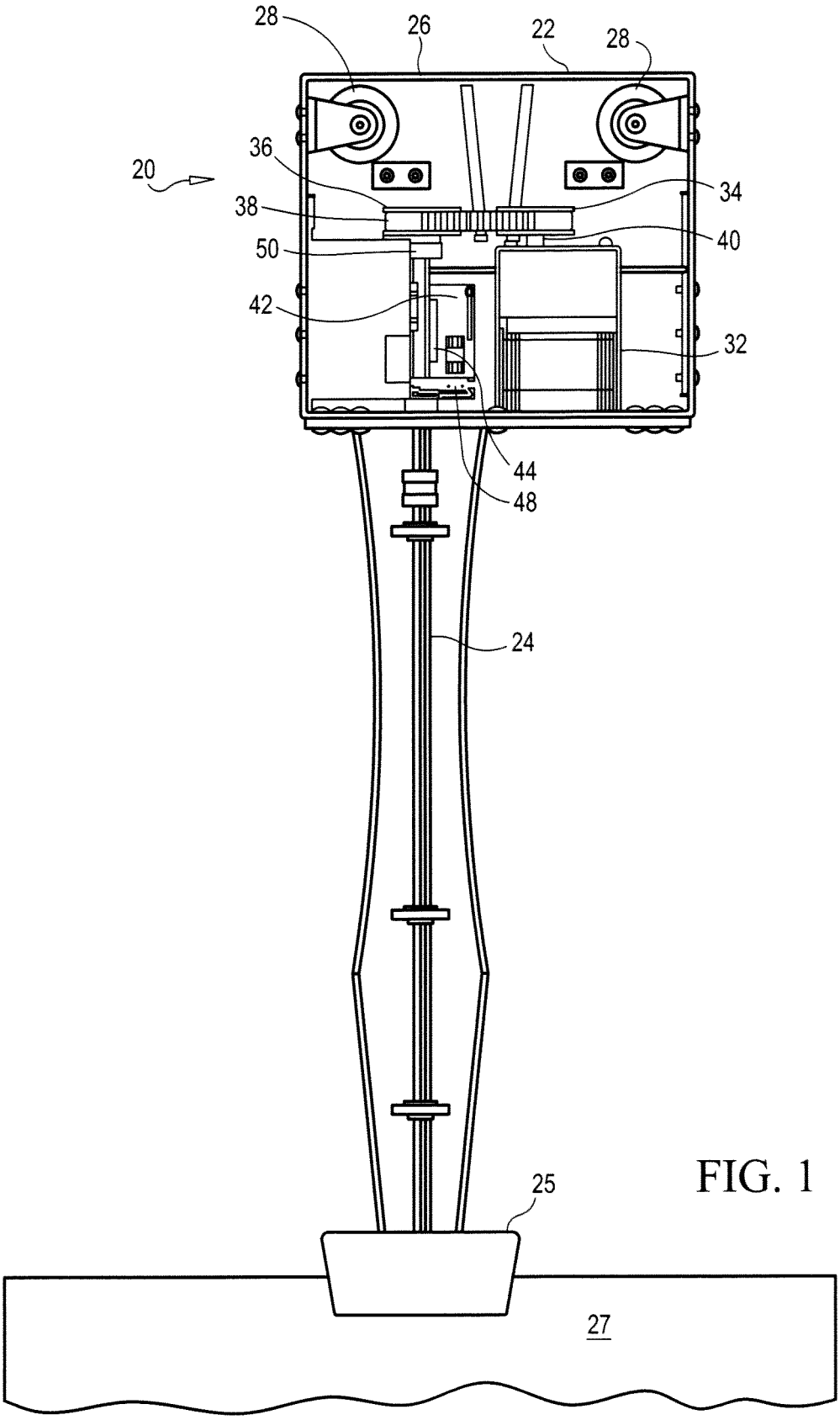
FIG. 1 is a cross-sectional front elevation view of a target positioning system according to the present embodiments.

The following detailed description describes the present embodiments with reference to the drawings. In the drawings, reference numbers label elements of the present embodiments. These reference numbers are reproduced below in connection with the discussion of the corresponding drawing features.

The embodiments of the present target positioning systems and methods are described below with reference to the figures. These figures, and their written descriptions, indicate that certain components of the apparatus are formed integrally, and certain other components are formed as separate pieces. Those of ordinary skill in the art will appreciate that components shown and described herein as being formed integrally may in alternative embodiments be formed as separate pieces. Those of ordinary skill in the art will further appreciate that components shown and described herein as being formed as separate pieces may in alternative embodiments be formed integrally. Further, as used herein the term integral describes a single unitary piece.

Reengagement at Only One Position Over Entire Rotational Range of Motion

The present embodiments include features that enable a shaft of the present target positioning system to reengage a rotational disengagement mechanism only once over the entire rotational range of motion of the shaft. This feature ensures that the target is always facing in a direction that the system assumes it's facing, as described below. In some embodiments the rotational range of motion of the shaft may be 360°, but in other embodiments it may be only 180°, 90°, or any other angular range.

Figure 2:
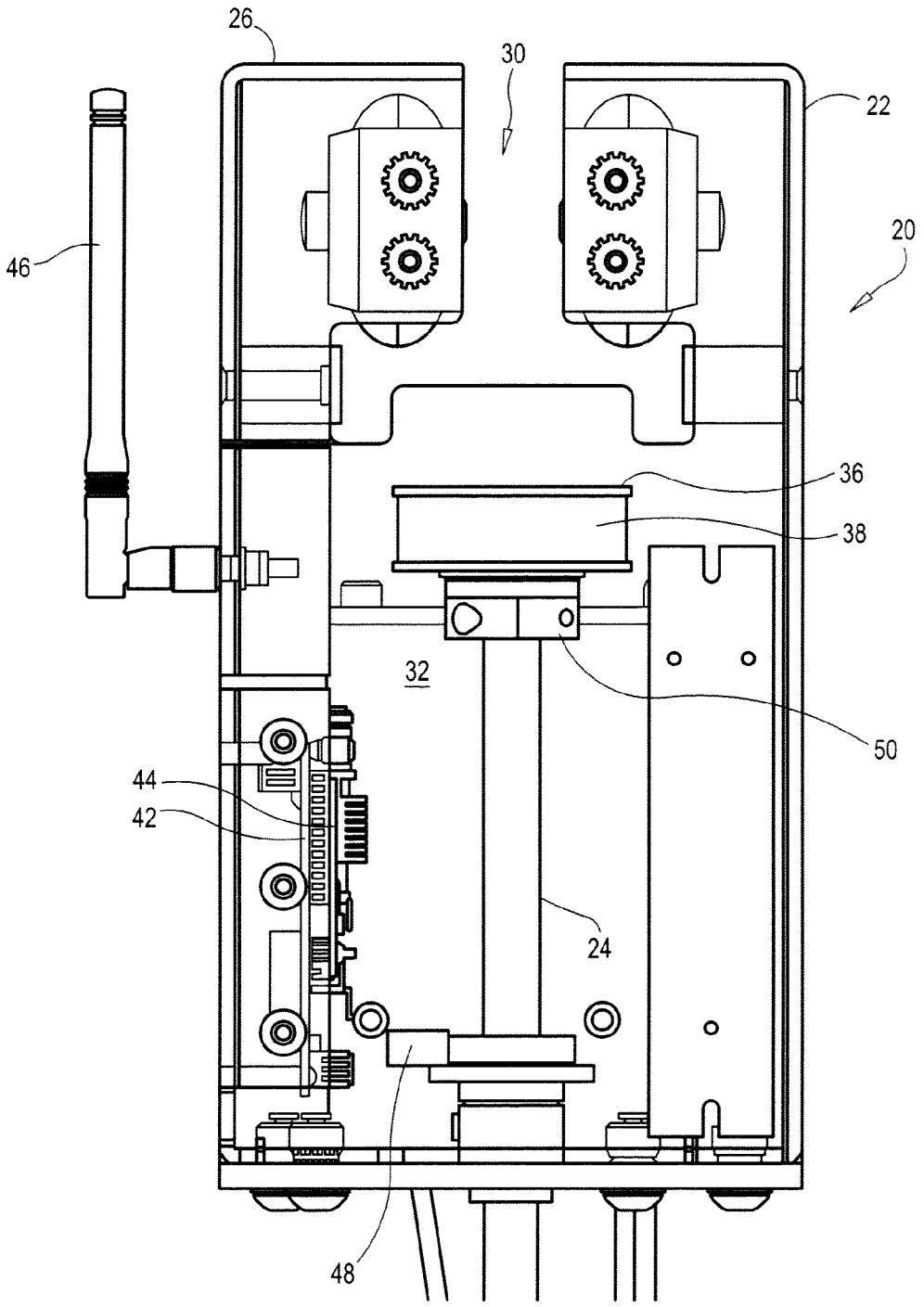
FIG. 2 is a cross-sectional side view of the target positioning system of FIG. 1.

FIGS. 1 and 2 illustrate a cross-sectional front elevation view and a cross-sectional side elevation view, respectively, of a target positioning system 20 according to the present embodiments. The system 20 includes a housing 22 with a rotatable shaft 24 extending downward from the housing 22. A lower end of the rotatable shaft 24 includes apparatus, such as a clamp 25, for gripping a target 27 of the type used to practice shooting firearms.

An upper portion 26 of the housing 22 supports two pairs of rotatable wheels 28 located fore and aft. The wheels 28 ride on a rail (not shown) that extends through a channel 30 (FIG. 2) in the upper portion 26 of the housing 22. In some embodiments, the wheels 28 may be passive, such that the system 20 is stationary. In other embodiments, the wheels 28 may be driven, such that the system 20 may be moved from side to side with respect to the shooter. In other embodiments, the system 20 may be configured so that the target 27 can be moved toward and away from the shooter. In other embodiments, the system may not include any wheels.

The housing 22 contains a powered drive unit 32, which may in some embodiments be an electric motor. The drive unit 32 is operationally coupled to the rotatable shaft 24 through a pair of pulleys 34, 36 and a belt 38. With reference to FIG. 1, a first one of the pulleys 34 is secured to an output shaft 40 of the drive unit 32, and a second one of the pulleys 36 is secured to the rotatable shaft 24. The belt 38 extends around both pulleys 34, 36 such that rotation of the first pulley 34 induces rotation of the second pulley 36. Thus, when the powered drive unit 32 is activated, it induces rotation of the rotatable shaft 24 through the pulleys 34, 36 and the belt 38. Rotating the shaft 24 enables the target 27 secured thereto to be rotationally positioned at a desired orientation, as described further below. In alternative embodiments, the pulley and belt engagement between the powered drive unit 32 and the rotatable shaft 24 can be replaced by any suitable engagement means, such as interlocking gears. The pulley and belt engagement is just one example, and should not be interpreted as limiting.

With continued reference to FIGS. 1 and 2, the housing 22 further contains a control unit 42. The control unit 42 includes a processor 44 for executing code to direct the operation of the powered drive unit 32 and, thus, rotation of the rotatable shaft 24. The control unit 42 issues commands to the powered drive unit 32 to rotate the shaft 24, and thus the target 27, to a desired orientation. A wireless antenna 46 (FIG. 2) communicates with the control unit 42 to enable a user, such as a shooter, to send commands to the control unit 42. In some embodiments, communication with the control unit 42 may be via a wired connection such as a data cable. The housing 22 further contains a position indicator 48 associated with the rotatable shaft 24 for detecting a rotational orientation of the rotatable shaft 24. The position indicator 48 may comprise an encoder, a barcode and barcode reader, a switch, or any other device for detecting a rotational orientation of a shaft 24. If the position indicator 48 is an encoder, the encoder may be a magnetic encoder or an optical encoder, for example.

The housing 22 further contains a rotation disengagement mechanism associated with the shaft 24. The rotation disengagement mechanism is configured to disengage the rotatable shaft 24 from the powered drive unit 32 such that, upon disengagement, the powered drive unit 32 is no longer able to rotate the shaft 24. The rotation disengagement mechanism may comprise, for example, a torque limiter 50, and for simplicity will be referred to herein as a torque limiter 50. However, that designation should not be viewed as limiting, as any other suitable device for disengaging the rotatable shaft 24 from the powered drive unit 32 may be substituted for it.

A torque limiter 50 is an off-the-shelf component familiar to those of ordinary skill in the art. Accordingly, the present torque limiter 50 will not be described in exhausting detail. However, generally, the torque limiter 50 may comprise a ball detent type limiter, which transmits force through a hardened ball that rests in a detent within the torque limiter 50. In some embodiments, the torque limiter may include more than one hardened ball. In such embodiments, the construction of the torque limiter 50 is such that engagement is only possible when all of the hardened balls rest within the detents, which is only possible once per revolution due to the unique angular displacement of the detents. An over-torque condition pushes the balls out of their detents, thereby decoupling the shaft 24.

Figure 3:
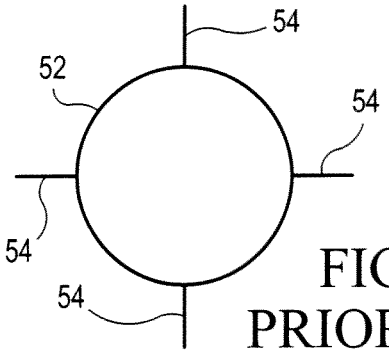
FIG. 3 PRIOR ART
FIG. 3 is a schematic representation of a rotation engagement/disengagement mechanism known in the prior art.
Figure 4:
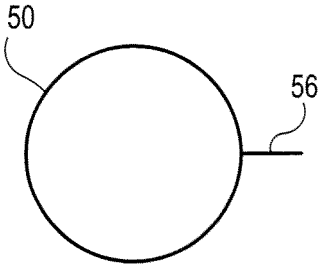
FIG. 4 is a schematic representation of a rotation engagement/disengagement mechanism according to the present embodiments.

FIGS. 3 and 4 illustrate one advantage of the present system 20 over the prior art. FIG. 3 illustrates, schematically, a prior art torque limiter 52 having four engagement positions 54, each spaced 90° from one another. Such a torque limiter 52 provides engagement at every 90° of rotation. If the torque limiter 52 of FIG. 3 is used in a target positioning system, as is the case with some products on the market today, the shaft that supports the target 27 is able to reengage the powered drive unit at every 90° of rotation. Thus, if the target 27 rotates due to an externally applied force, thereby disengaging the shaft from the torque limiter 52, activating the drive unit to rotate the shaft may cause reengagement of the shaft with the torque limiter 52 at any of the four positions 54 shown in FIG. 3. But, only one of these four positions corresponds to the default or intended position of the target 27. Thus, after reengagement of the shaft with the torque limiter 52, the target positioning system may "believe" that the target 27 is facing the shooter, when, in fact, it is facing a direction 90° from the shooter, 180° from the shooter, or 270° from the shooter. The system then requires recalibration or manual adjustment to resume normal operation.

FIG. 4 illustrates, schematically, the torque limiter 50 of one of the present embodiments. The torque limiter 50 provides engagement at only one rotational position 56 over the entire rotational range of motion of the shaft 24. Thus, if the target 27 coupled to the shaft 24 receives an externally applied force that induces rotation of the shaft 24, thereby disengaging the shaft 24 from the torque limiter 50, the rotatable shaft 24 may reengage the torque limiter 50 (FIG. 1) at only one rotational position 56, which corresponds to the intended position. It is thus not possible for the target 27 to be facing in any direction other than the direction that the target positioning system 20 "thinks" it is facing. The system 20 thus does not require manual adjustment to resume normal operation, and may be easily recalibrated when the shaft 24 disengages the torque limiter 50. Example methods for recalibrating the target 27 after the shaft 24 disengages the torque limiter 50 are described below. The torque limiter may, in some embodiments, comprise multiple indentations at fixed angular displacements and actuation rings that are pushed together by disk springs. In the event of a torque overload, the spring disengages to allow the balls to come out of their detents, thereby separating the drive and the driven components from one another.

In the illustrated embodiment, the rotational range of motion of the shaft is 360°, but in other embodiments it may be only 180°, 90°, or any other angular range. The present embodiments are not limited to engagement at only one rotational position per 360° of rotation.

Figure 5:
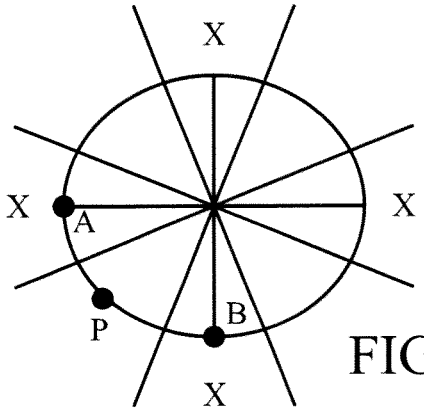
FIG. 5 is a schematic representation of a method for determining whether or not a target is out of a desired rotational orientation, according to the present embodiments.

As discussed above, the present embodiments include a position indicator 48, such as an encoder. The encoder position indicator 48 detects the rotational orientation of the target 27. Disengagement, over-shoot (rotating the target 27 farther than intended), under-shoot (rotating the target 27 less than intended), stalling (when the mechanical components of the powered drive unit 32 cannot follow the electrical charge within a command, due to external forces or disruptions; may not be sufficient to disengage the torque limiter 50, but great enough to make to the powered drive unit 32 miss a few steps (angles) or completely stall), and positioning error are defined by the difference between the actual rotational orientation of the target 27 and the desired rotational orientation, as defined by the user. With reference to FIG. 5, the user determines a tolerance (X) that defines positioning error. In some embodiments, when the target 27 is rotated by an externally applied force to move the target 27 outside of the predefined displacement tolerance, X, the control unit 42, through the position indicator 48, detects the unwanted movement, and the system 20 enters a calibration or reengagement mode. The target 27 is then automatically repositioned to the desired position.

For example, upon initialization of the present system 20, the control unit 42 turns the powered drive unit 32, and, as a result, the shaft 24 and the attached target 27 rotate in a first direction. Preferably, the amount of rotation is greater than 360° to ensure that the torque limiter 50 is engaged and ready for normal operation. In one embodiment, the amount of rotation may be about 450°. The control unit 42 and powered drive unit 32 then rotate the target 27 in a second direction opposite the first direction until a predefined start position (face) is confirmed by receiving a signal from the position indicator 48. This process is illustrated further below with reference to FIG. 5.

Continuous Calibration

The present embodiments include features to detect any disengagement and/or positioning error of the target 27 and to react accordingly to rotate the target 27 to the desired position. The advantage of these features is that range down-time is reduced and training does not have to be suspended for other shooters to calibrate one shooter's target. These features are described below.

FIG. 5 is a schematic representation of a method for determining whether or not a target 27 is out of a desired rotational orientation, according to the present embodiments. The control unit 42 generates a command to move the target 27 from point A to point B, and the position P of the target 27 is monitored. The position of the target 27 at point B is then detected, and an error is indicated if point B is not located within a preset angular tolerance range X. The system 20 then enters the calibration or reengagement mode and the target 27 is automatically repositioned to the desired position within the tolerance range X.

Figure 6:
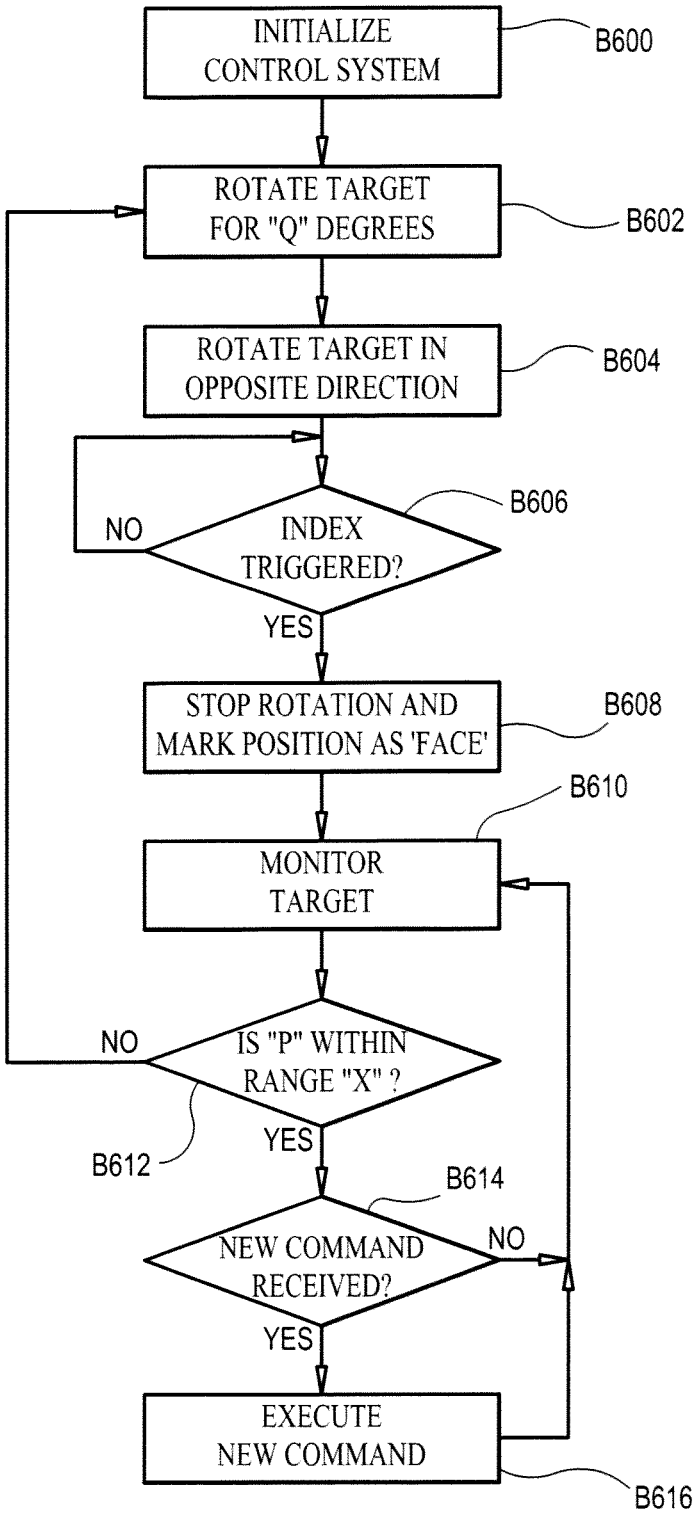
FIG. 6 is a flowchart illustrating a method for positioning a target according to the present embodiments.

FIG. 6 is a flowchart illustrating the foregoing method for positioning a target 27, and for self-calibrating the present target positioning systems. At block B600 the control unit 42 is initialized. The target 27 is then rotated a desired number of degrees, degrees, in a first direction, and then rotated in a second direction opposite the first direction, at blocks B602 and B604. As discussed above, the magnitude of Q is preferably greater than 360° to ensure that the torque limiter 50 is engaged and ready for normal operation. In one embodiment. Q is about 450°.

At block B606 the process monitors the rotational position of the shaft 24 until an index is triggered, indicating that the target 27 has reached the face position. The process then advances to block B608, where rotation of the target 27 is stopped at the face position and the face status is marked.

At block B610 the target 27 is monitored, and as long as the target 27 remains within the tolerance range X (block B612) and no command is received (block B614), the target monitoring continues. However, if at block B612 the target 27 is found to be outside the tolerance range X, the process returns to block B602. Similarly, if at block B614 a command is received, the process advances to block B616 and the received command is executed. The process then loops back to block B610 where the target 27 is monitored.

In another embodiment, the target 27 is rotated from a first position $P_1$ to a second position $P_2$ and an elapsed time for the rotation is measured. The rotational speed of the powered drive unit 32 is known, and therefore the time necessary to rotate the target 27 from point $P_1$ to point $P_2$, $time_{Expected}$, or $t_E$, is known. Thus, if $t_E$ does not equal the actual elapsed time, $time_{Actual}$, or $t_A$, during rotation of the shaft, then the target 27 is out of position. The system 20 then enters the calibration or reengagement mode and the target 27 is automatically repositioned to the desired position.

Figure 7:
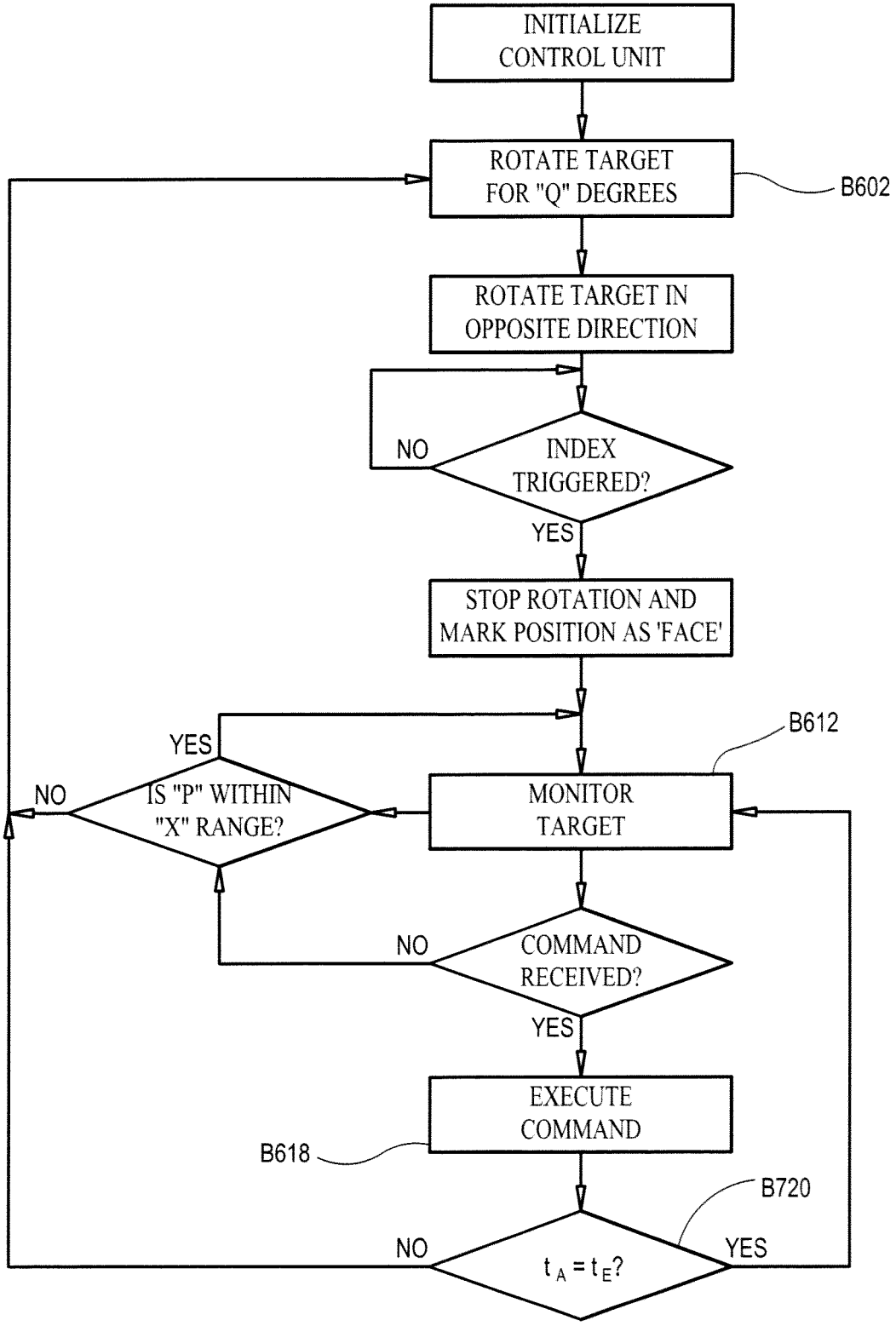
FIG. 7 is a flowchart illustrating a method for positioning a target according to the present embodiments.

FIG. 7 is a flowchart illustrating the foregoing method for positioning a target 27, and for self-calibrating the present target positioning systems. Where the process steps of FIG. 7 are identical to those described above with respect to FIG. 6, the description of those steps will not be repeated here. The only difference between the processes of FIGS. 6 and 7 is that after the command is executed at block B618, the process of FIG. 7 advances to block B720, where it is determined whether $t_A$ is equal to $t_E$. If $t_A$ is equal to $t_E$, then the target 27 is in the desired orientation, and the process loops back to block B612. However, if $t_A$ is not equal to $t_E$, then the target 27 is out of position, and the process loops back to block B612.

"Smart Positioning" Logic

The embodiments of the present system 20 and methods further include "smart positioning" logic to register the actual position of the target 27 at all times. In this logic, the control unit 42 assigns numbers to the following target positions:

Face: When the front side of the target 27 is facing the shooter;

Back: When the back side of the target 27 is facing the shooter; and

Edge: When either edge of the target 27 is facing the shooter.

Figure 8:
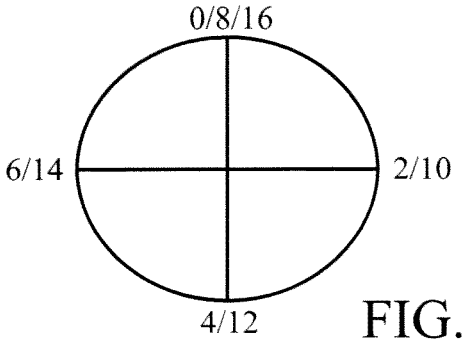
FIG. 8 is a schematic representation of a method for positioning a target according to the present embodiments.

The following numbers are assigned to the foregoing positions, as shown in FIG. 8:

Face: 0/8/16;

Back: 4/12;

First Edge: 2/10; and

Second Edge: 6/14.

These numbers are stored in memory associated with the control unit 42. The number 8 is assigned to a starting position (Face), and as the powered drive unit 32/target 27 rotates, new numbers are assigned to the current position in increments of 2 for each of the above four positions. For example, if the user turns the motor 180° clockwise from the face position, the position number becomes 12, and if the user turns the powered drive unit 32/target 27 180° counterclockwise, the position number becomes 4. The same logic applies to rotation to all of the above positions. In order to limit the current position number to the pre-defined numbers, an exceptional subroutine converts 0 and 16 to 8 whenever the "virtual position" is assigned one of the two. In these embodiments, the face position is considered the start position. In other embodiments any other position can be selected as the start position, as dictated by user preference.

Figure 9:
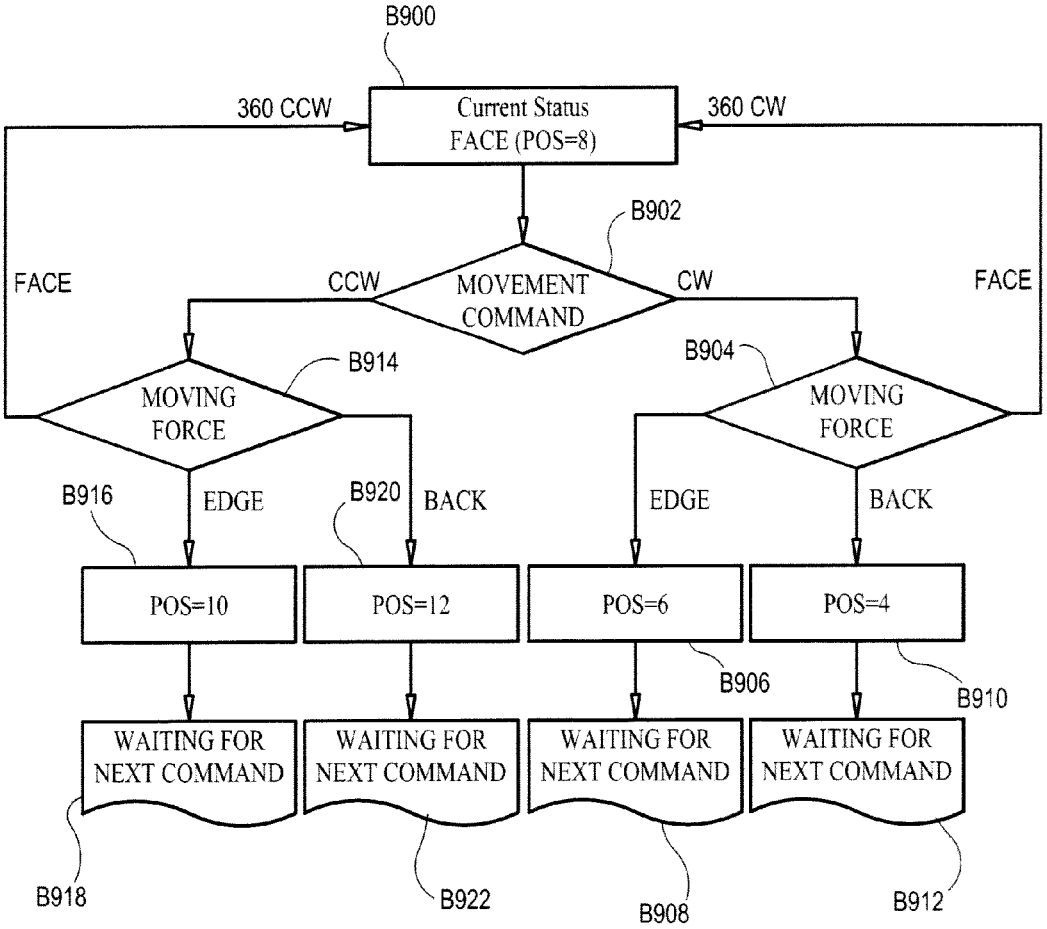
FIG. 9 is a flowchart illustrating a method for positioning a target according to the present embodiments.
Figure 10:
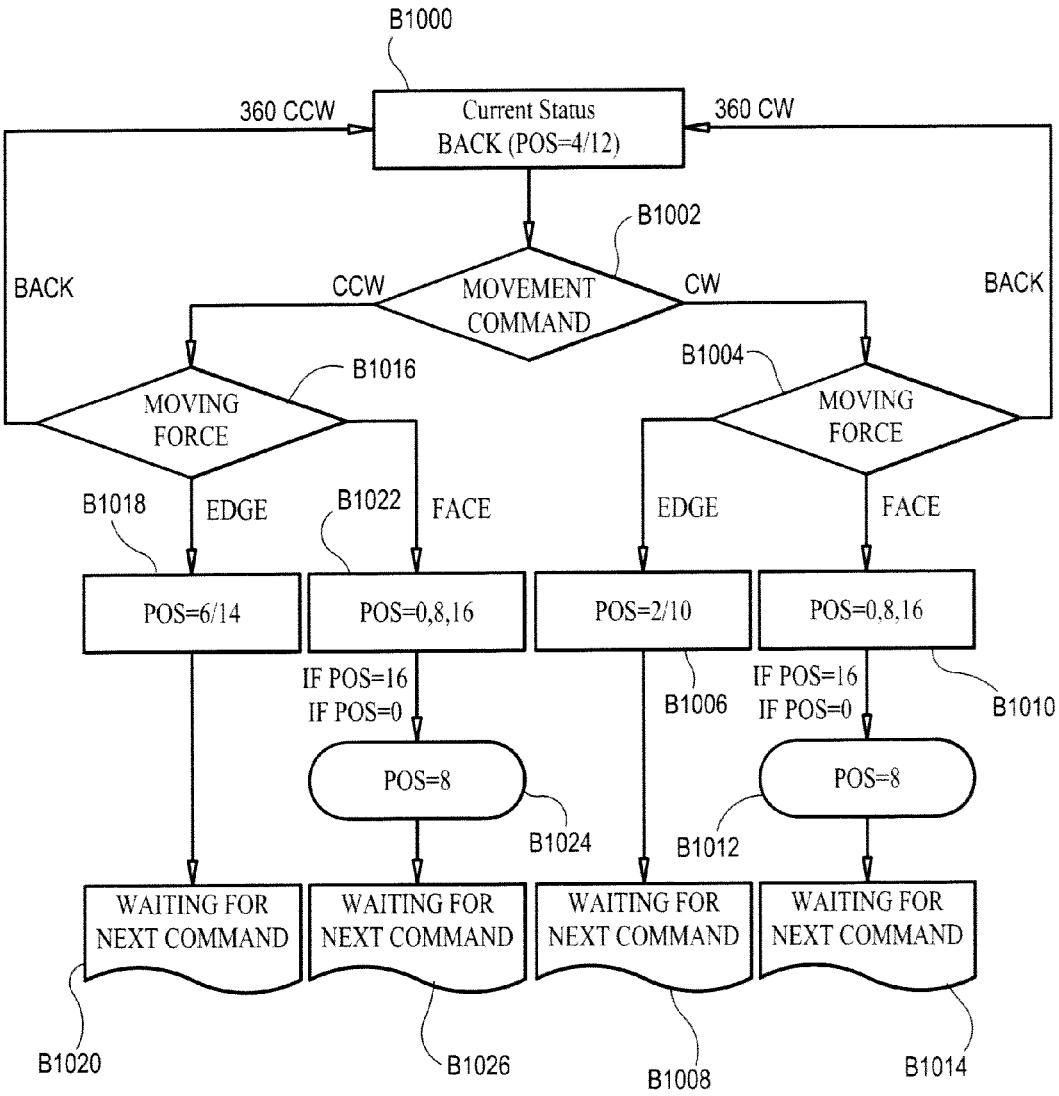
FIG. 10 is a flowchart illustrating a method for positioning a target according to the present embodiments.

FIGS. 9 and 10 are flowcharts illustrating the present embodiments for positioning a target 27 according to the above-described smart positioning logic. In FIG. 9, the target 27 begins in the face position, indicated by the position number 8, at block B900. At block B902 the control unit 42 receives a command to rotate the target 27. If the command is to rotate clockwise, then the process moves to block B904 where the control unit 42 commands the powered drive unit 32 to apply a rotational force to the shaft 24/target 27. If the command is to rotate the target 27 90° clockwise, then at block B906 the target 27 is in the edge position POS=6. The system 20 then waits for the next command at block B908. However, if the command received at block B902 is to rotate the target 27 180° clockwise, then at block B910 the target 27 is in the back position POS=4. The system 20 then waits for the next command at block B912. And if the command received at block B902 is to rotate the target 27 360° clockwise, then the process loops back to block B900, where the target 27 is in the face position indicated by the position number 8.

Referring back to block B902, if the command received is to rotate counterclockwise, then the process moves to block B914 where the control unit 42 commands the powered drive unit 32 to apply a rotational force to the shaft 24/target 27. If the command is to rotate the target 27 90° counterclockwise, then at block B916 the target 27 is in the edge position POS=10. The system 20 then waits for the next command at block B918. However, if the command received at block B902 is to rotate the target 27 180° counterclockwise, then at block B920 the target 27 is in the back position POS=12. The system 20 then waits for the next command at block B922. If the command received at block B902 is to rotate the target 27 360° counterclockwise, then the process loops back to block B900, where the target 27 is in the face position indicated by the position number 8.

In FIG. 10, the target 27 begins in the back position, indicated by the position number 4 or 12, at block B1000. At block B1002 the control unit 42 receives a command to rotate the target 27. If the command is to rotate clockwise, then the process moves to block B1004 where the control unit 42 commands the powered drive unit 32 to apply a rotational force to the shaft 24/target 27. If the command is to rotate the target 27 90° clockwise, then at block B1006 the target 27 is in the edge position POS=2/10. The system 20 then waits for the next command at block B1008. However, if the command received at block B1002 is to rotate the target 27 180° clockwise, then at block B1010 the target 27 is in the face position, which is indicated by the position number 0, 8 or 16. If the position number is 0 or 16, the system 20 converts the position number to 8 at block B1012. The system 20 then waits for the next command at block B1014. If the command received at block B1002 is to rotate the target 27 360° clockwise, then the process loops back to block B1000, where the target 27 is in the back position indicated by the position number 4 or 12.

Referring back to block B1002, if the command received is to rotate counterclockwise, then the process moves to block B1016 where the control unit 42 commands the powered drive unit 32 to apply a rotational force to the shaft 24/target 27. If the command is to rotate the target 27 90° counterclockwise, then at block B1018 the target 27 is in the edge position POS=6/14. The system 20 then waits for the next command at block B1020. However, if the command received at block B1002 is to rotate the target 27 180° counterclockwise, then at block B1022 the target 27 is in the face position, which is indicated by the position number 0, 8 or 16. If the position number is 0 or 16, the system 20 converts the position number to 8 at block B1024. The system 20 then waits for the next command at block B1026. If the command received at block B1002 is to rotate the target 27 360° counterclockwise, then the process loops back to block B1000, where the target 27 is in the back position indicated by the position number 4 or 12.

In other embodiments, the target may begin from either edge position 2,10 or 6,14. In these embodiments, the smart positioning logic process would proceed similarly to the above-described processes, with appropriate adjustments to indicate the position of the target with each rotation.

The above description presents the best mode contemplated for carrying out the present systems and methods, and of the manner and process of practicing them, in such full, clear, concise, and exact terms as to enable any person skilled in the art to which they pertain to practice these systems and methods. These systems and methods are, however, susceptible to modifications and alternate constructions from those discussed above that are fully equivalent. Consequently, these systems and methods are not limited to the particular embodiments disclosed. On the contrary, these systems and methods cover all modifications and alternate constructions coming within the spirit and scope of the systems and methods as generally expressed by the following claims, which particularly point out and distinctly claim the subject matter of the systems and methods.

What is claimed is:

1. Apparatus for rotationally positioning a target, the apparatus comprising:

a rotatable shaft having a lower end configured to support a target and an upper end operatively coupled to a powered drive unit configured to rotate the shaft to any of a plurality of rotational positions around an axis; and a rotation disengagement mechanism operatively coupling the shaft to the powered drive unit and operable to disengage the rotatable shaft from the powered drive unit at any of the plurality of rotational positions in response to a threshold rotational force applied to the shaft, and to allow the shaft to be reengaged with the powered drive unit at only the rotational position at which the shaft was disengaged from the powered drive unit.

2. The apparatus of claim 1, wherein the rotation disengagement mechanism comprises a torque limiter.

3. The apparatus of claim 1, further comprising a position indicator associated with the rotatable shaft for detecting a rotational orientation of the rotatable shaft.

4. The apparatus of claim 3, wherein the position indicator comprises an encoder, a barcode and barcode reader, or a switch.

5. The apparatus of claim 1, further comprising a control unit including a processor for executing code to direct the operation of the powered drive unit.

6. A system for continuously calibrating a rotatable shaft so that the shaft is at a desired rotational orientation, the system comprising:

a rotatable shaft having a lower end configured to support a target and an upper end operatively coupled to a powered drive unit configured to rotate the shaft among a plurality of rotational positions around an axis;

a rotation disengagement mechanism operatively coupling the shaft to the powered drive unit;

a position indicator associated with the rotatable shaft for detecting a rotational orientation of the rotatable shaft; and a control unit including a processor for executing code to direct the operation of the powered drive unit;

wherein the system is configured to rotate the powered drive unit by an amount sufficient to rotate the rotation disengagement mechanism in a first direction by an amount greater than 360° to ensure the rotatable shaft is engaged with the powered drive unit;

rotate the shaft in a second direction opposite the first direction;

detect a rotational orientation of the rotatable shaft; and halt rotation of the shaft in the second direction when the detected rotational orientation of the shaft corresponds to the desired rotational orientation.

7. The system of claim 6, wherein the position indicator comprises an encoder, a barcode and barcode reader, or a switch.

8. A method of positioning a rotatable shaft at a desired rotational orientation, the method comprising:

rotating a powered drive unit operatively coupled to the rotatable shaft by an amount sufficient to rotate a rotation disengagement mechanism associated with the shaft in a first direction by an amount greater than 360';

while rotating the rotation disengagement mechanism, engaging the rotatable shaft with the powered drive unit so that the rotatable shaft rotates under the influence of the powered drive unit;

rotating the shaft in a second direction opposite the first direction;

detecting a rotational orientation of the rotatable shaft; and halting rotation of the shaft in the second direction when the detected rotational orientation of the shaft corresponds to the desired rotational orientation.

9. The method of claim 8, wherein the rotatable shaft may engage the powered drive unit for rotation therewith at only one rotational position relative to the rotation disengagement mechanism.

10. The method of claim 8, further comprising monitoring the detected rotational orientation and, if the detected rotational orientation is more than a threshold amount away from the desired rotational orientation, initiating a corrective action.

11. The method of claim 10, wherein the corrective action comprises repeating the steps recited in claim 8.

12. The method of claim 8, further comprising monitoring the detected rotational orientation and, if a command to rotate the shaft is received, executing the received command.

13. A method of correcting a rotational position of a rotatable shaft, the method comprising:

rotating the shaft from a first rotational position to a second rotational position;

detecting a first rotational orientation of the rotatable shaft at the second position;

determining whether the rotational orientation of the rotatable shaft at the second position falls within a predetermined angular distance of a desired rotational position of the rotatable shaft; and if it is determined that the rotational orientation of the rotatable shaft at the second position does not fall within the predetermined angular distance, executing a corrective action, comprising:

rotating a powered drive unit operatively coupled to the rotatable shaft by an amount sufficient to rotate a rotation disengagement mechanism associated with the shaft in a first direction by an amount greater than 360°:

while rotating the rotation disengagement mechanism, engaging the rotatable shaft with the powered drive unit so that the rotatable shaft rotates under the influence of the powered drive unit;

rotating the shaft in a second direction opposite the first direction;

detecting a second rotational orientation of the rotatable shaft; and halting rotation of the shaft in the second direction when the detected second rotational orientation of the shaft corresponds to the desired rotational orientation.

14. A method of correcting a rotational position of a rotatable shaft, the method comprising:

rotating the shaft from a first rotational position to a second rotational position;

measuring an actual elapsed time $t_A$ during rotation of the shaft;

comparing $t_A$ to an expected quantity of time necessary to rotate the shaft from the first rotational position to the second rotational position, $t_E$; and if $t_A \neq t_E$, determining that the rotatable shaft is not at a desired rotational position and executing a corrective action comprising:

rotating a powered drive unit operatively coupled to the rotatable shaft by an amount sufficient to rotate a rotation disengagement mechanism associated with the shaft in a first direction by an amount greater than 360°;

while rotating the rotation disengagement mechanism, engaging the rotatable shaft with the powered drive unit so that the rotatable shaft rotates under the influence of the powered drive unit;

rotating the shaft in a second direction opposite the first direction;

detecting a rotational orientation of the rotatable shaft; and halting rotation of the shaft in the second direction when the detected rotational orientation of the shaft corresponds to the desired rotational orientation.

* * * * *